United States Patent [19]

Kato et al.

[11] Patent Number: 4,485,787

[45] Date of Patent: Dec. 4, 1984

[54] FUEL INJECTION SYSTEM

[75] Inventors: Masaaki Kato, Toyoake; Tetsuji Akashi, Oobu, both of Japan

[73] Assignee: Nippondenso Co., Ltd., Kariya, Japan

[21] Appl. No.: 524,316

[22] Filed: Aug. 18, 1983

[30] Foreign Application Priority Data

Aug. 27, 1982 [JP] Japan ..... 57-148767

[51] Int. Cl.[3] ..... F02M 57/02

[52] U.S. Cl. ..... 123/446; 123/501; 239/88

[58] Field of Search ..... 123/446, 447, 467, 501, 123/502; 239/88-93

[56] References Cited

U.S. PATENT DOCUMENTS

| | | | |
|---|---|---|---|
| 4,281,792 | 8/1981 | Sisson et al. | 123/502 |
| 4,385,609 | 5/1983 | Kato | 123/446 |
| 4,396,151 | 8/1983 | Kato et al. | 123/446 |
| 4,399,793 | 8/1983 | Poore et al. | 123/467 |
| 4,402,456 | 9/1983 | Schneider | 239/91 |
| 4,418,867 | 12/1983 | Sisson | 239/88 |
| 4,425,894 | 1/1984 | Kato et al. | 123/446 |
| 4,427,152 | 1/1984 | Sisson et al. | 239/90 |

FOREIGN PATENT DOCUMENTS 52-81425 7/1977 Japan .

*Primary Examiner*—Magdalen Y. C. Moy

*Attorney, Agent, or Firm*—Cushman, Darby & Cushman

[57] ABSTRACT

A fuel injection system for an internal combustion engine has a fuel injection pump for controlling the amount of fuel injected in accordance with operating conditions of the engine, and a fuel injection nozzle unit for injecting the fuel delivered from the fuel injection pump into a combustion chamber. In the fuel injection nozzle unit, an injection pump chamber is located in a nozzle housing thereof so as to receive the fuel delivered from the fuel injection pump. The pressurized fuel in the fuel injection pump chamber is delivered by an injection plunger to an injection nozzle thereof. A pressure pump chamber is also located in the nozzle housing so as to receive a fluid. This fluid is pressurized by the pressurizing plunger which reciprocates in synchronism with the engine. The injection plunger pressurizes the fuel in the injection pump chamber by the pressure of the fuel in the pressure pump chamber, thereby supplying the pressurized fuel to an injection nozzle.

12 Claims, 7 Drawing Figures

FUEL INJECTION SYSTEM

BACKGROUND OF THE INVENTION

The present invention relates to a fuel injection system for injecting fuel into a combustion chamber of an internal combustion engine and, more particularly, to a fuel injection system especially suitable for a diesel engine.

Conventionally, a fuel injection system is provided in a diesel engine so as to inject fuel into a combustion chamber of the engine. In general, a fuel injection system of this type comprises a combination of a fuel delivering means such as a fuel injection pump and a nozzle unit for pressurizing the fuel so as to inject the fuel into the combustion chamber. In this system, the fuel delivered from the fuel delivering means is fed to the nozzle unit and is injected from a nozzle of the nozzle unit into the combustion chamber.

In this type of fuel injection system, the amount of fuel to be injected into the combustion chamber must vary in accordance with the operating conditions of the engine. For example, when the driver strongly depresses the accelerator pedal or the engine is operated at a high load, the amount of fuel to be injected must be increased. However, when the engine is operated at a low load, the amount of fuel to be injected must be decreased.

For this reason, in the fuel injection system, the fuel delivering means has the function of adjusting the amount of injected fuel in accordance with the operating conditions of the engine. Therefore, a proper amount of fuel must be delivered from the fuel delivering means to the nozzle unit. The fuel is then injected from the nozzle unit to the combustion chamber.

A check valve is also disposed to prevent reverse flow of the fuel toward the fuel delivering means when the fuel supplied from the fuel delivering means is pressurized and injected. This check valve allows proper high-pressure injection of the fuel and highly precise adjustment of an injection amount corresponding to the operating conditions of the engine.

However, when the check valve described above is used, the pressurization efficiency of the fuel is often degraded to an extent corresponding to the volume of the check valve. If leakage occurs in the check valve, the pressurization efficiency is degraded and at the same time the injection amount cannot be properly delivered. Furthermore, use of the check valve results in an increase in the number of component parts of the nozzle unit and hence a large size unit.

SUMMARY OF THE INVENTION

It is an object of the present invention to provide a simple fuel injection system having a high fuel pressurization efficiency and providing precise fuel injection amounts in accordance with operating conditions of the engine.

In order to achieve the above and other objects of the present invention, there is provided a fuel injection system for an internal combustion engine, comprising: fuel delivering means for delivering a predetermined amount of fuel in accordance with operating conditions of the engine; and fuel injection means for injecting the fuel delivered from said fuel delivering means into the combustion chamber of the engine, said fuel injection means including a nozzle housing mounted at a cylinder head of the engine, the nozzle housing containing an injection cylinder chamber, a pressure cylinder chamber and a metering channel, the metering channel communicating said fuel delivering means to the injection cylinder chamber through the pressure cylinder chamber, an injection nozzle disposed at one end of said nozzle housing and being adapted to inject the fuel into the combustion chamber, an injection plunger slidably inserted in the injection cylinder chamber, said injection plunger being adapted to partition the injection cylinder chamber into an injection pump chamber and a pressurizing chamber, the injection pump chamber receiving the predetermined amount of fuel from said fuel delivering means through the metering channel and the pressure cylinder chamber, a pressurizing plunger slidably fitted in the pressure cylinder chamber, the pressurizing plunger containing a pressure pump chamber which communicates with the pressurizing chamber in the pressure cylinder chamber, the metering channel being opened and closed by the movement of the pressurizing plunger, supplying means for supplying a fluid to the pressure pump chamber and the pressurizing chamber, and pressurizing plunger driving means adapted to reciprocate said pressurizing plunger in synchronism with the engine so that the metering channel is opened to supply the fuel from said fuel delivering means to the injection pump chamber when said pressurizing plunger moves in one direction, and that the metering channel is closed and the fluid in the pressure pump chamber and the pressurizing chamber is pressurized, when the pressurizing plunger moves in another direction, to move said injection plunger in a direction so as to pressurize the fuel in the injection pump chamber.

DETAILED DESCRIPTION OF THE PREFERRED EMBODIMENTS

Figure 1:
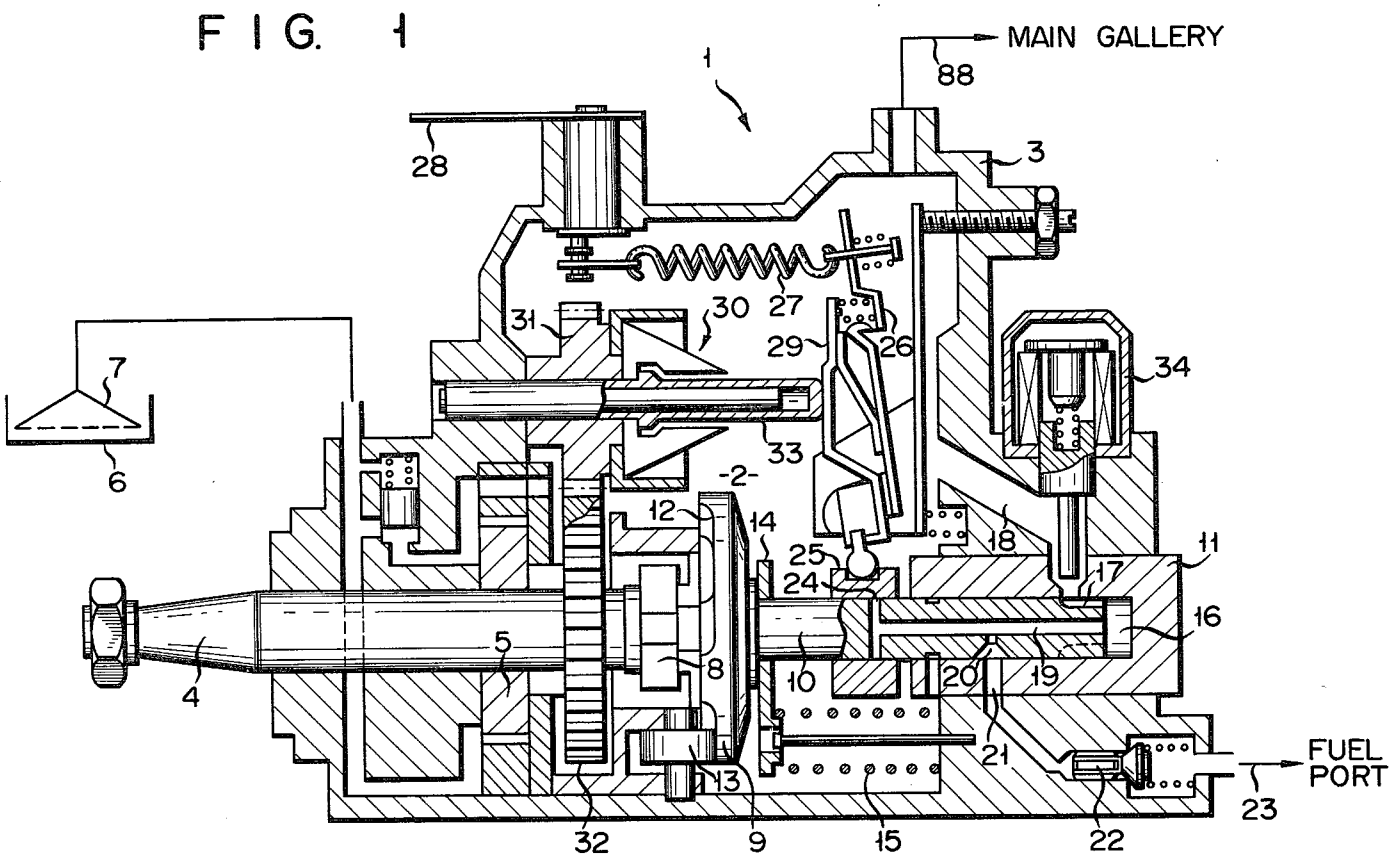
FIG. 1 is a longitudinal sectional view of a distributor type fuel injection pump used in a fuel injection system according to a first embodiment of the present invention.
Figure 2:
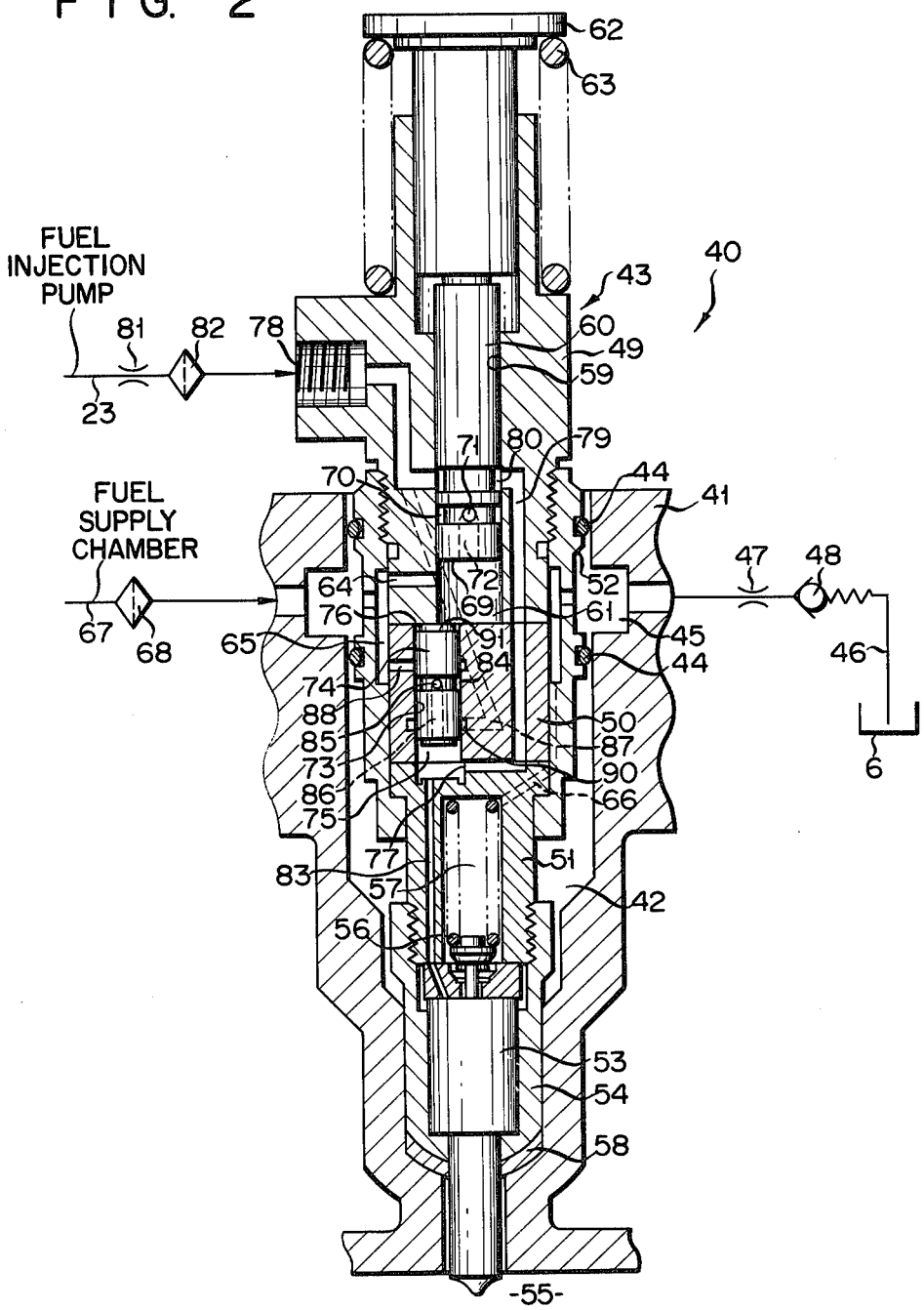
FIG. 2 is a longitudinal sectional view of a fuel injection nozzle unit of the system of the first embodiment of the present invention.

FIGS. 1 and 2 show the overall construction of a fuel injection system for an internal combustion engine according to a first embodiment of the present invention.

FIG. 1 shows a distributor type fuel injection pump 1 used in the system. Since the pump 1 is well known, it will be only briefly described as follows.

The pump 1 has a pump housing 3 which defines a fuel supply chamber 2 therein. A cam shaft 4 is rotatably supported in the pump housing 3. One end of the cam shaft 4 extends outside the pump housing 3 and is connected to a crank shaft (not shown) of a diesel engine through a power transmission mechanism (not shown). The cam shaft 4 is rotated in synchronism with the diesel engine. A fuel pump 5 is disposed at a portion of the cam shaft 4 which extends inside the pump housing 3. Upon rotation of the cam shaft 4, the fuel pump 5 is driven to supply fuel from a fuel tank 6 to the fuel supply chamber 2 through a strainer 7.

A face cam 9 is coupled to the other end of the cam shaft 4 which extends inside the pump housing 3 through a joint 8. The face cam 9 is also connected to a distributing plunger 10 which is coaxial with the cam shaft 4. The distributing plunger 10 is slidably fitted in a distributing cylinder 11 supported by the pump housing 3.

Rollers 13 roll on a cam surface 12 of the face cam 9. A spring seat 14 is mounted at that portion of the distributing plunger 10 which is in the vicinity of the face cam 9. A restoring spring 15 is disposed between the spring seat 14 and the inner surface of the housing 3 so as to be parallel to the distributing plunger 10. When the face cam 9 is rotated upon rotation of the cam shaft 4, the cam surface 12 slidably contacts the roller 13, allowing the face cam 9 to reciprocate along the axial direction of the cam shaft 4. In other words, the distributing plunger 10 rotates and reciprocates in the distributing cylinder 11 upon rotation of the cam shaft 4. In particular, the distributing plunger 10 reciprocates a number of times corresponding to the number of cylinders of the engine while the distributing plunger 10 is rotated by one revolution.

The interior of the distributing cylinder 11 contains a distributing pump chamber 16 with a plunger 10 located inside. A plurality of suction grooves 17 are formed at equal intervals along the outer surface of the head of the distributing plunger 10. The suction grooves 17 communicate with the distributing pump chamber 16. The suction grooves 17 can also selectively communicate with an intake channel 18 formed in the housing 3 and the distributing cylinder 11 at a predetermined angular position of the distributing plunger 10. The intake channel 18 always communicates with the fuel supply chamber 2, as may be apparent from FIG. 1. When one of the suction grooves 17 communicates with the intake channel 18, the fuel is introduced from the fuel supply chamber 2 to the distributing pump chamber 16 through the intake channel 18 and the suction groove 17.

A communicating channel 19 is formed to extend axially along the distributing plunger 10. The communicating channel 19 communicates with the distributing pump chamber 16. A distributing groove 20 is cut in a central portion of an outer surface of the distributing plunger 10. The distributing groove 20 communicates with the communicating channel 19. The distributing groove 20 can also communicate with one of discharge channels 21 formed in the pump housing 3 and the distributing cylinder 11. The number of discharge channels 21 equals the number of cylinders of the engine. Only one discharge channel 21 is illustrated in FIG. 1. Each of the discharge channels 21 is connected to a fuel injection nozzle unit 40 (to be described later) through a discharge valve 22 and a fuel channel 23.

The communicating channel 19 can also communicate with the fuel supply chamber 2 through a spill port 24. The spill port 24 can be opened/closed by a spill ring 25 slidably fitted on the outer surface of the distributing plunger 10.

The spill ring 25 is used to control the opening/closing timing of the spill port 24. In particular, the spill ring 25 is coupled to an adjusting lever 28 through a lever 26 and a spring 27. That is, in accordance with the degree of depression of an accelerator pedal (not shown), the spill ring 25 is moved along the axial direction of the distributing plunger 10 through the adjusting lever 28, the spring 27 and the lever 26.

The lever 26 is coupled to a centrifugal governor 30 through another lever 29. The centrifugal governor 30 is rotated by the cam shaft 4 through gears 31 and 32. When the centrifugal governor 30 is rotated upon rotation of the cam shaft 4, the centrifugal governor 30 actuates its governor sleeve 33 in accordance with the engine speed, thereby moving the spill ring 25 along the axial direction of the distributing plunger 10 through the lever 29.

A solenoid valve 34 is disposed midway along the intake channel 18, as shown in FIG. 1. The solenoid valve 34 serves as a cut-off valve to close the intake channel 18 and stop the supply of fuel when the engine is stopped.

The operation of the fuel injection pump 1 will be described below. When the cam shaft 4 is rotated in synchronism with the engine, the distributing plunger 10 reciprocates in the distributing cylinder 11 by the action of face cam 9 and the rollers 13. When the distributing plunger 10 is moved in such a direction as to increase the volume of the distributing pump chamber 16, one of the suction grooves 17 communicates with the intake channel 18 upon rotation of the distributing plunger 10, as shown in FIG. 1. Therefore, the fuel is drawn by suction from the fuel supply chamber 2 and is introduced to the distributing pump chamber 16 through the intake channel 18 and the suction groove 17. This operation is the fuel intake process of the fuel injection pump 1. During the intake process, the spill port 24 is closed by the spill ring 25, and the distributing groove 20 is also held in the closed position. Thereafter, when the distributing plunger 10 is moved in the direction to decrease the volume of the distributing pump chamber 16, upon rotation of the distributing plunger 10, the suction groove 17 no longer communicates with the intake channel 18. At this point, the fuel in the distributing pump chamber 16 is pressurized by the distributing plunger 10. The fuel pressurizing process of the fuel injection pump 1 is thus started. When the fuel in the distributing pump chamber 16 is pressurized to a predetermined pressure during this pressurizing process, the distributing groove 20 starts communicating with one discharge channel 21. Therefore, the pressurized fuel is delivered from the distributing pump chamber 16 to the fuel injection nozzle unit 40 through the communicating channel 19, the distributing groove 20, the discharge channel 21, the discharge valve 22 and the fuel channel 23. At the end of the fuel pressurizing process, the spill port 24 is opened by the spill ring 25. The pressurized fuel in the distributing pump chamber 16 spills into the fuel supply chamber 2 through the communicating channel 19 and the spill port 24. In this condition, the fuel is not delivered to the discharge channel 21 through the distributing groove 20. As a result, during the pressurizing process, the amount of fuel delivered to the fuel injection nozzle unit 40 is adjusted by the timing of the opening of the spill port 24.

Meanwhile, the spill ring 25 is moved along the axial direction of the distributing plunger 10 by the adjusting lever 28 and the centrifugal governor 30, so that the position of the spill ring 25 relative to the spill port 24 changes in accordance with the operating conditions of the engine. That is, the spill port 24 is opened/closed in accordance with the operating conditions of the engine. As a result, the amount of fuel to be delivered from the fuel injection pump 1 to the fuel injection nozzle unit 40 can be adjusted in accordance with the operating conditions of the engine.

The above-described operation indicates the fuel delivery process with respect to a single fuel injection nozzle unit. However, in practice, the fuel delivery processes are repeated the same number of times as the number of cylinders of the engine while the distributing plunger 10 is rotated by 360°. The proper amount of pressurized fuel is delivered to each of fuel injection nozzle units 40.

The pressurized fuel delivered from the fuel injection pump 1 is supplied to the fuel injection nozzle unit 40 through the fuel channel 23. The fuel injection nozzle unit 40 is illustrated in FIG. 2, and its construction will be described below.

As shown in FIG. 2, the fuel injection nozzle unit 40 has a nozzle housing 43 fitted in a hole 42 made in a cylinder head 41 of the engine. An annular main gallery 45 is located between the outer surface of the nozzle housing 43 and the inner surface of the hole 42. The annular main gallery 45 is kept oiltight by O-rings 44. The main gallery 45 is connected to the fuel tank 6 by a return channel 46, an orifice 47, and a check valve 48.

The nozzle housing 43 has a pressure cylinder portion 49, an injection cylinder portion 50 and a nozzle holder portion 51 extending from the upper portion to the lower portion in FIG. 2 in the order named. The cylinder portions 49 and 50 and the holder portion 51 are coupled and assembled by a holder nut 52. Referring to FIG. 2, an injection nozzle 53 is coupled to the lower end of the nozzle holder portion 51 along the axial direction of the nozzle housing 43 through a retaining nut 54. The injection nozzle 53 has a nozzle tip which is exposed inside a combustion chamber 55. The injection nozzle 53 comprises a known nozzle needle. A nozzle spring 56 is housed in a spring housing 57 defined at the lower portion of the nozzle holder portion 51. A copper gasket 58 is mounted between the retaining nut 54 and the bottom wall of the hole 42 so as to seal the combustion chamber 55.

A pressure cylinder chamber 59 is located in the pressure cylinder portion 49. A pressurizing plunger 60 is slidably fitted in the pressure cylinder chamber 59. A pressure pump chamber 61 is located between the lower end of the plunger 60 and the top surface of the injection cylinder portion 50.

The upper end (FIG. 2) of the pressurizing plunger 60 is coupled to a cam follower 62. The cam follower 62 slidably contacts a cam (not shown) which is rotated in synchronism with rotation of the engine. The plunger 60 is depressed (FIG. 2) by the cam. A follower spring 63 is disposed between the cam follower 62 and the outer surface of the pressure cylinder portion 49. The pressurizing plunger 60 is biased by the spring 63 so as to move upward to its original position.

A supply hole 64 is open to the inner surface of the pressure pump chamber 61. The supply hole 64 communicates with an annular subgallery 65 defined between the outer surface of the cylinder portions 49, 50 and the inner surface of the holder nut 52. The subgallery 65 communicates with the main gallery 45. The subgallery 65 communicates with the spring housing 57 through a channel 66 indicated by the broken line in FIG. 2.

The main gallery 45 communicates with the fuel supply chamber 2 of the fuel injection pump 1 through a supply pipe 67 provided with filter 68, as shown in FIGS. 1 and 2. Therefore, the fuel in the fuel supply chamber 2 of the fuel injection pump 1 can be introduced into the pressure pump chamber 61 through the main gallery 45, the subgallery 65 and the supply hole 64, when the lower end of the pressurizing plunger 60 is positioned at a position higher than that of the supply hole 64, as shown in FIG. 2. That is, the lower end (FIG. 2) of the pressurizing plunger 60 serves as a timing lead 69 which opens/closes the supply hole 64.

An annular spill groove 70 is located at a lower portion of the outer surface of the pressurizing plunger 60. The spill groove 70 communicates with the pressure pump chamber 61 through transverse and longitudinal holes 71 and 72, respectively, which are located in the pressurizing plunger 60.

An injection cylinder chamber 73 is located in the injection cylinder portion 50 and the nozzle holder portion 51. An injection plunger 74 is slidably fitted in the injection cylinder chamber 73 along the axial direction thereof. The injection cylinder chamber 73 is partitioned by the injection plunger 74 into an injection pump chamber 75 and a pressurizing chamber 76.

It should be noted that the diameter of the pressuring plunger 60 is greater than that of the injection plunger 74. In this case, the pressurizing plunger 60 is disposed substantially in tandem with the injection plunger 74.

The pressurizing chamber 76 always communicates with the pressure pump chamber 61. A fuel hole 77 is open at the lower inner surface of the injection pump chamber 75. The fuel hole 77 can communicate with a fuel port 78 formed in the outer surface of the pressure cylinder portion 49 through a metering channel 79. The fuel port 78 is connected to the fuel channel 23. A balancing orifice 81 and a filter 82 are arranged in the fuel channel 23.

The metering channel 79 is formed in the pressure cylinder portion 49, the injection cylinder portion 50 and the nozzle holder portion 51. The metering channel 79 can be opened/closed upon movement of the pressuring plunger 60. As shown in FIG. 2, the metering channel 79 crosses the pressure cylinder chamber 59. An annular metering groove 80 is formed in the outer surface of the pressuring plunger 60 at a position above the spill groove 70 so as to allow/stop communication of the metering channel 79. Therefore, the pressurized fuel delivered from the fuel injection pump 1 is introduced into the injection pump chamber 75 through the fuel channel 23, the metering channel 79 and the metering groove 80, when the pressurizing plunger 60 is located at a position indicated in FIG. 2.

The injection pump chamber 75 is also connected to the injection nozzle 53 through an injection channel 83, as may be apparent from FIG. 2.

An annular spill groove 84 is formed at the central portion of the injection plunger 74. The spill groove 84 communicates with the injection pump chamber 75 through a transverse hole 85 and a longitudinal hole 86 which are formed in the injection plunger 74. The spill groove 84 serves to open/close an annular spill port 90 formed in the inner surface of the injection cylinder chamber 73. The spill port 90 connects with the portion of the metering channel 79 between the fuel port 78 and the pressure cylinder chamber 59 through a spill channel 87 indicated by the broken line in FIG. 2.

Again referring to FIG. 2, an annular drain lead 91 is formed at the top portion of the injection plunger 74. The drain lead 91 serves to open/close an annular drain port 88 which is open to the inner surface of the injection cylinder chamber 73. The drain port 88 communicates with the subgallery 65.

The operation of the fuel injection nozzle unit 40 will now be described.

When the pressurizing plunger 60 is moved upward from the lower dead point upon the action of the cam follower 62 and the spring 63, the supply hole 64 is opened by the timing lead 69, thereby introducing the fuel from the subgallery 65 to the pressure pump chamber 61.

On the other hand, upon upward movement of the pressurizing plunger 60, when the metering channel 79 is opened through the metering groove 80 of the plunger 60, as shown in FIG. 2, the pressurized fuel from the fuel injection pump 1 is introduced into the injection pump chamber 75 through the metering channel 79. In this case, the amount of the fuel delivered from the pump 1 is adjusted in accordance with the operating conditions of the engine as previously described. The predetermined amount of pressurized fuel corresponding to the given operating conditions of the engine is placed in the injection pump chamber 75. Then, the injection plunger 74 is moved upward and stopped at a position wherein the displacement of the injection plunger 74 corresponds to the amount of the pressurized fuel placed in the injection pump chamber 75. It should be noted that the pressurized fuel is introduced until the pressurizing plunger 60 reaches its upper dead point.

Thereafter, when the pressurizing plunger 60 is moved downward from its upper dead point, it tends to pressurize the fuel in the pressure pump chamber 61. However, at the initial period of downward movement of the pressuring plunger 60, the supply hole 64 is held opened, so that the fuel in the pressure pump chamber 61 is spilled toward the subgallery 65. Under this condition while the pressurizing plunger 60 is moved downward, the metering channel 79 is closed by the pressurizing plunger 60. The pressurized fuel introduced in the injection pump chamber 75 is trapped in the injection pump chamber 75 since the metering channel 79 is blocked and the reverse flow of the pressurized fuel from the injection pump chamber 75 to the fuel injection pump 1 is completely prevented.

When the pressurizing plunger 60 is further moved downward to close the supply hole 64, the fuel in the pressure pump chamber 61 is pressurized upon downward movement of the pressurizing plunger 60. In this manner, when the pressure of the fuel in the pressure pump chamber 61 is increased, the pressure is transmitted to the pressurizing chamber 76, thereby urging the injection plunger 74 downward. Therefore, the injection plunger 74 is moved downward. In this case, it should be noted that the injection plunger 74 is moved downward at a speed corresponding to a ratio of the pressure-receiving area of the plunger 74 to that of the plunger 60. By downward movement of the injection plunger 74, the pressurized fuel in the injection pump chamber 75 is further pressurized to a higher pressure. When the pressure of the pressurized fuel in the injection pump chamber 75 has reached a predetermined value determined by the spring 56, the highly pressurized fuel is delivered from the injection pump chamber 75 to the injection nozzle 53 through the injection channel 83 and is injected from the injection nozzle 53 to the combustion chamber 55 of the engine. As a result, the fuel is injected in the combustion chamber 55 of the engine when the pressurization start moment in the pressure pump chamber 61 occurs.

During injection of the pressurized fuel, when the spill groove 84 of the injection plunger 74 communicates with the spill port 90, the pressurized fuel in the injection pump chamber 75 which is pressurized upon downward movement of the injection plunger 74 is no longer supplied to the injection nozzle 53. The fuel is then spilled in the spill port 90 through the longitudinal hole 86 and the transverse hole 85 of the injection plunger 74. The fuel returns from the spill port 90 to the metering channel 79 through the spill channel 87. Therefore, when the spill groove 84 communicates with the spill port 90, the fuel pressure in the injection pump chamber 75 is decreased, thereby stopping fuel injection from the injection nozzle 53.

It should be noted that the timing at which the spill groove 84 communicates with the spill port 90 is determined by the initial upper position of the injection plunger 74 which is in turn determined by the amount of pressurized fuel in the injection pump chamber 75. In other words, the amount of the pressurized fuel injected from the injection nozzle 53 is the same as that placed in the injection pump chamber 75 from the fuel injection pump 1. As a result, the pressurized fuel can be injected from the injection nozzle 53 in the proper amount controlled by the fuel injection pump 1 in accordance with the operating conditions of the engine.

The fuel returning from the spill port 90 to the metering channel 79 is introduced again in the injection pump chamber 75 when the metering groove 80 in the pressurizing plunger 60 communicates with the metering channel 79, thereby improving the adjusting efficiency of the fuel in the nozzle unit 40.

Even after the injection nozzle 53 stops injecting the fuel, the pressurizing plunger 60 continues to move downward, so that the injection plunger 74 is moved downward. Upon downward movement of the injection plunger 74, when the drain port 88 is opened by the drain lead 91 of the injection plunger 74, the fuel in the pressure pump chamber 61 returns to the subgallery 65 through the pressurizing chamber 76 and the drain port 88.

At this moment, downward movement of the injection plunger 74 is stopped.

Even after downward movement of the injection plunger 74 is stopped, the pressurizing plunger 60 continues to move downward. Upon downward movement of the pressurizing plunger 60, when the spill groove 70 communicates with the supply hole 64, the fuel in the pressure pump chamber 61 is spilled to the subgallery 65 through the longitudinal hole 72, the transverse hole 71 and the supply hole 64.

Thereafter, when the pressurizing plunger 60 has reached its lower dead point, it is moved upward again. The above-described operation is then repeated.

Only a connection between the fuel injection pump 1 and a single fuel injection nozzle unit 40 is illustrated in FIGS. 1 and 2. However, in practice, the fuel injection pump 1 is also connected to the fuel injection nozzle units 40 of the other cylinders of the engine in the same manner as described above.

According to the first embodiment of the present invention, when the fuel in the injection pump chamber 75 is pressurized, since the metering channel 79 is closed by the pressurizing plunger 60, the fuel in the injection pump chamber 75 will not return to the fuel injection pump 1. Therefore, in order to prevent such a reverse flow, a check valve need not be disposed, thereby simplifying the overall structure of the nozzle unit 40. Furthermore, since the pressurizing plunger 60 has a high mechanical strength, even if the pressure of the highly pressurized fuel is transmitted from the injection pump chamber 75 to the pressurizing plunger 60, the pressurizing plunger 60 will not be damaged. Therefore, the pressurizing plunger 60 properly closes the metering channel 79, thus preventing leakage of the pressurized fuel. As a result, the pressurization efficiency of the fuel injected from the injection nozzle 53 can be improved, and the injection amount can be adjusted with high precision.

Furthermore, in the first embodiment, the pressurized fuel in the injection pump chamber 75 is further pressurized to be injected from the injection nozzle 53, thereby preventing cavitation.

Figure 3:
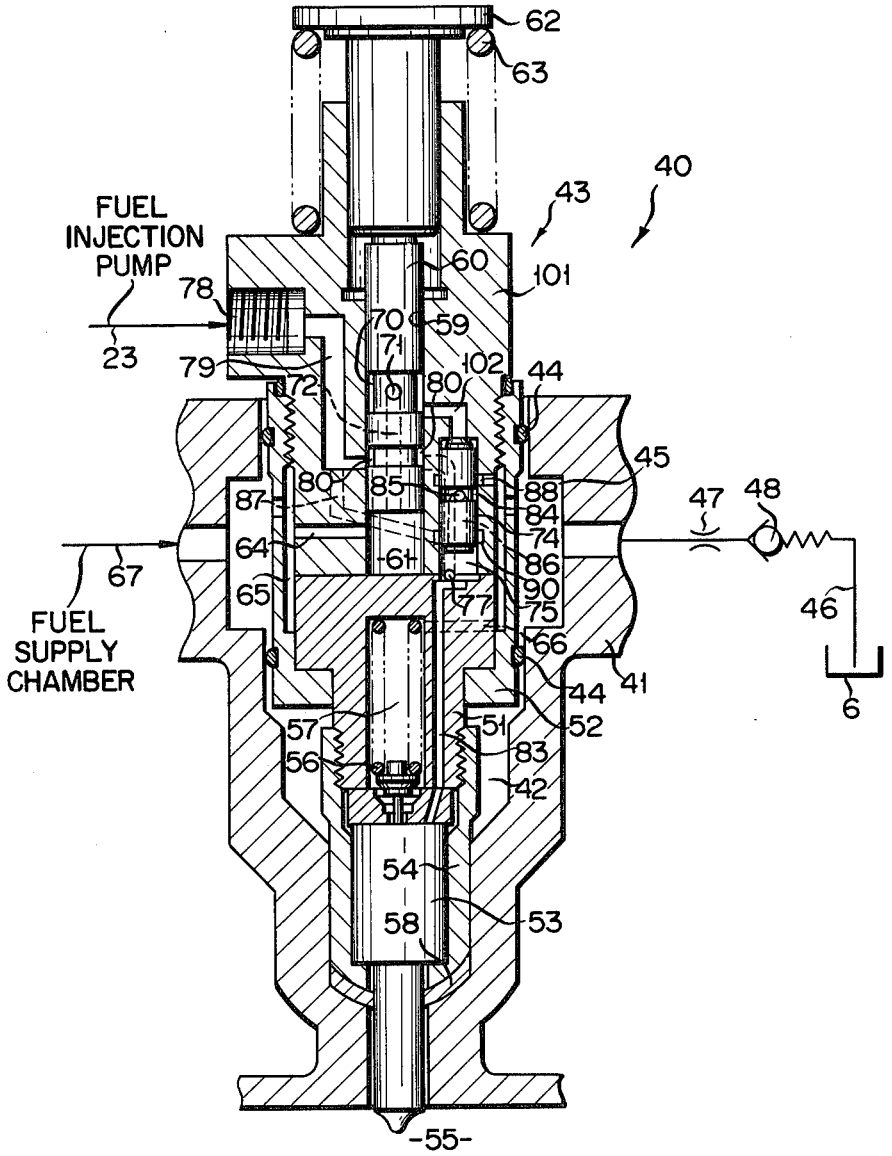
FIG. 3 is a longitudinal sectional view of a fuel injection nozzle unit of a fuel injection system according to a second embodiment of the present invention.

The present invention is not limited to the first embodiment. FIG. 3 shows a nozzle unit 40 according to a second embodiment of the present invention.

Referring to FIG. 3, a single cylinder body 101 contains the pressurizing cylinder portion and the injection cylinder portion. The pressure pump chamber 61 and the injection pump chamber 75 are located in the cylinder body 101 such that the pressure pump chamber 61 is substantially parallel to the injection pump chamber 75.

The positions of the metering groove 80 and the spill groove 70 are reversed as compared with the case in the first embodiment. The pressure pump chamber 61 is communicated with the pressuring chamber 76 through the longitudinal hole 72, the transverse hole 71, the spill groove 70 and a channel 102.

Every other feature of the structure in the second embodiment is the same as that in the first embodiment shown in FIG. 2. The same reference numerals used in FIG. 2 denote the same parts in FIG. 3, and therefore a detailed description is omitted.

According to the second embodiment, since the pressure pump chamber 61 and the injection pump chamber 75 are located in the single cylinder body 101 parallel to each other, the total number of component parts of the nozzle unit 40 is further decreased. Furthermore, the vertical dimension of the nozzle unit can also be decreased.

Figure 4:
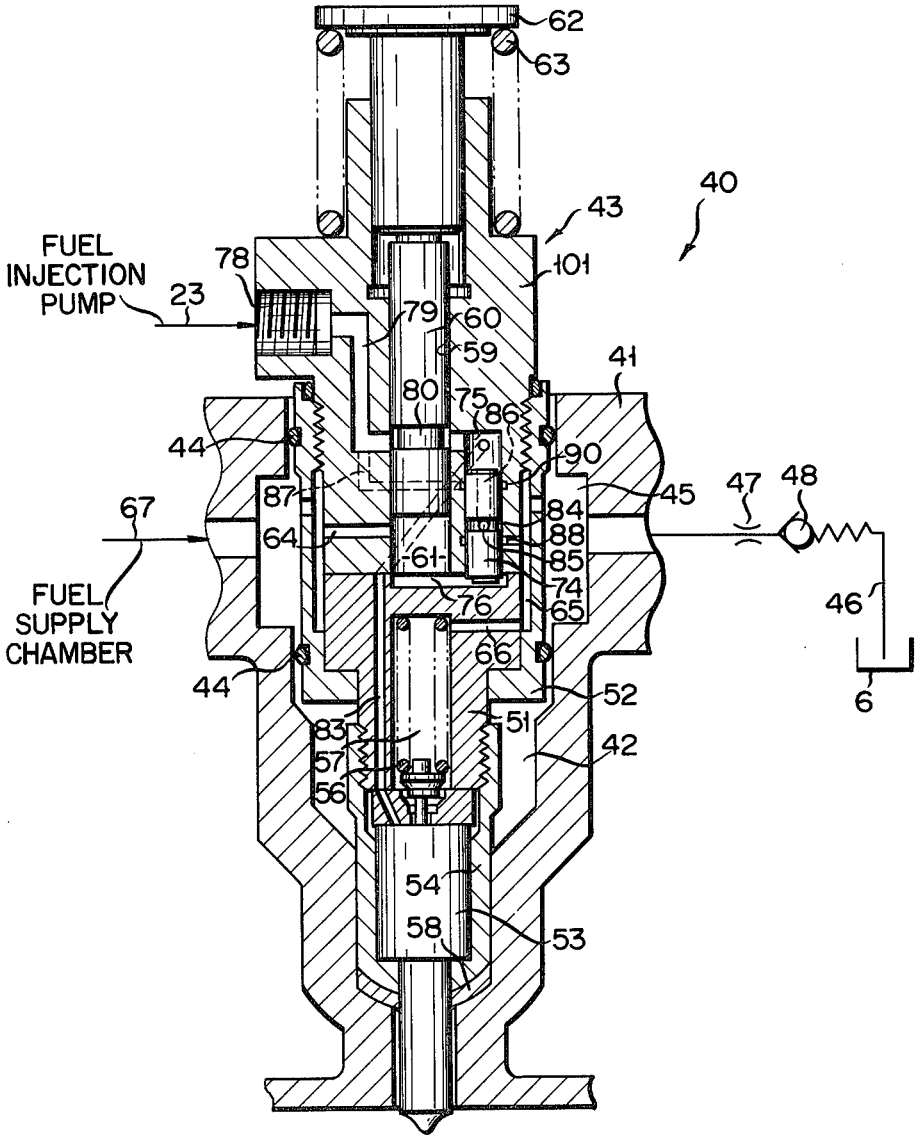
FIG. 4 is a longitudinal sectional view of a fuel injection nozzle unit of a fuel injection system according to a third embodiment of the present invention.

FIG. 4 shows a nozzle unit 40 according to a third embodiment of the present invention.

Referring to FIG. 4, the pressure pump chamber 61 and the injection pump chamber 75 are located in the single cylinder body 101 in the same manner as in the second embodiment, except that the injection plunger 74 is upside down such that the positions of the injection pump chamber 75 and the pressurizing chamber 76 are reversed.

According to the third embodiment, the spill groove 70 and the holes 71 and 72 used in the second embodiment can be omitted.

Figure 5:
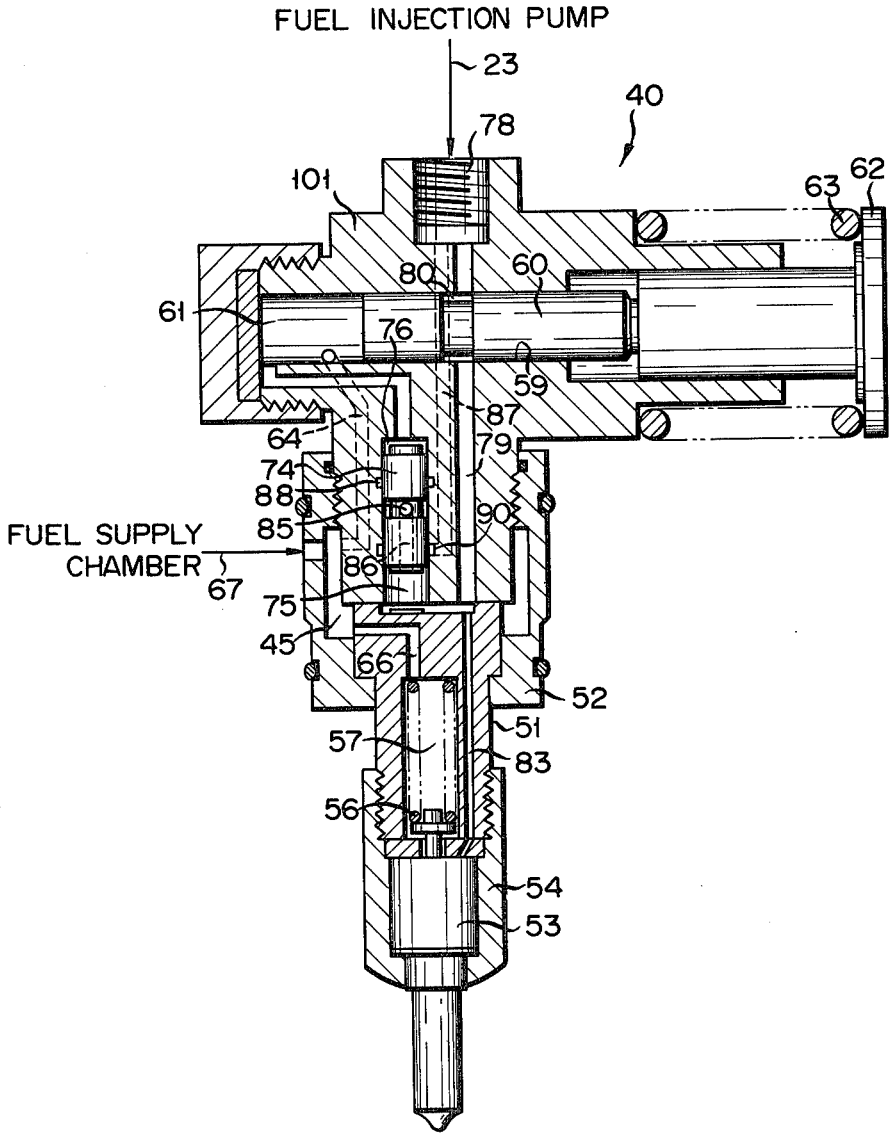
FIG. 5 is a longitudinal sectional view of a fuel injection nozzle unit of a fuel injection system according to a fourth embodiment of the present invention.

FIG. 5 shows a nozzle unit 40 according to a fourth embodiment of the present invention.

Referring to FIG. 5, the pressurizing plunger 60 and the injection plunger 74 are located in the single cylinder body 101 such that axes of the plungers 60 and 74 cross each other.

Figure 6:
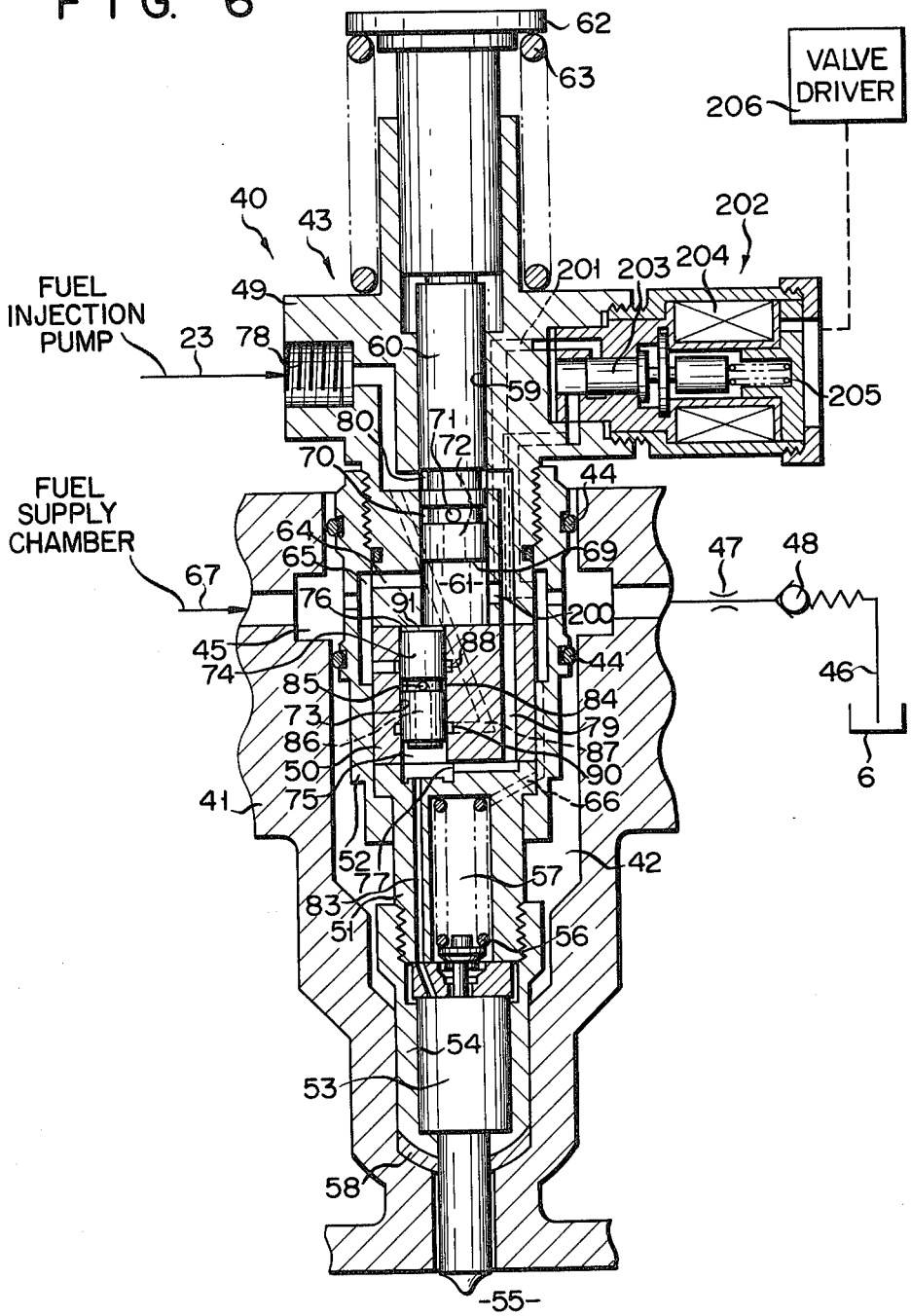
FIG. 6 is a longitudinal sectional view of a fuel injection nozzle unit of a fuel injection system according to a fifth embodiment of the present invention.

FIG. 6 shows a nozzle unit 40 according to a fifth embodiment of the present invention.

Referring to FIG. 6, the nozzle unit 40 has an injection timing control mechanism described below.

A timing port 200 is open at the lower portion of the pressure pump chamber 61. The timing port 200 communicates with the subgallery 65 through a timing channel 201 indicated by a dotted line in FIG. 6. The timing channel 201 is formed in the pressure cylinder portion 49.

A solenoid valve 202 is located in the timing channel 201. The solenoid valve 202 is mounted in the pressure cylinder portion 49 and drives a timing plunger 203 to open/close the timing channel 201. As shown in FIG. 6, when an electromagnetic coil 204 is energized and the timing plunger 203 is attracted to the right, the timing channel 201 is opened. However, when the electromagnetic coil 101 is deenergized, the timing plunger 203 is biased by a spring 205 to move to the left (FIG. 6), thereby closing the timing channel 201.

The operation of the solenoid valve 202 is controlled by a valve driver 206 shown in FIG. 6. The valve driver 206 is operated upon receipt of a signal from a sensor (not shown) for detecting the operating conditions (e.g., engine speed and load) of the engine. That is, the timing at which the solenoid valve 202 is opened is controlled by the valve driver 206 in accordance with the operating conditions of the engine.

According to the fifth embodiment described above, when the timing channel 201 is kept open by the timing plunger 203 of the solenoid valve 202, the fuel which is contained in the pressure pump chamber 61 and is to be pressurized is spilled to the subgallery 65 through the timing channel 201. For this reason, the injection plunger 74 will not be moved downward by the pressure of the fuel in the pressure pump chamber 61. Therefore, the fuel will not be injected from the injection nozzle 53. However, when the timing channel 201 is closed by the timing plunger, the fuel in the pressure pump chamber 61 is pressurized upon downward movement of the pressurizing plunger 60, as previously described. Then, the fuel can be injected from the injection nozzle 53.

According to the fifth embodiment, therefore, the operation of the solenoid valve 202 can be controlled by the valve driver 206, so that the injection start timing is controlled in accordance with the operating conditions of the engine.

In the first to fifth embodiments of the present invention, the fuel injection pump 1 is opened to deliver a preadjusted amount of fuel to the injection pump chamber 75. However, in the sixth embodiment shown in FIG. 7, a fuel delivery mechanism is used in place of the fuel injection pump 1.

Figure 7:
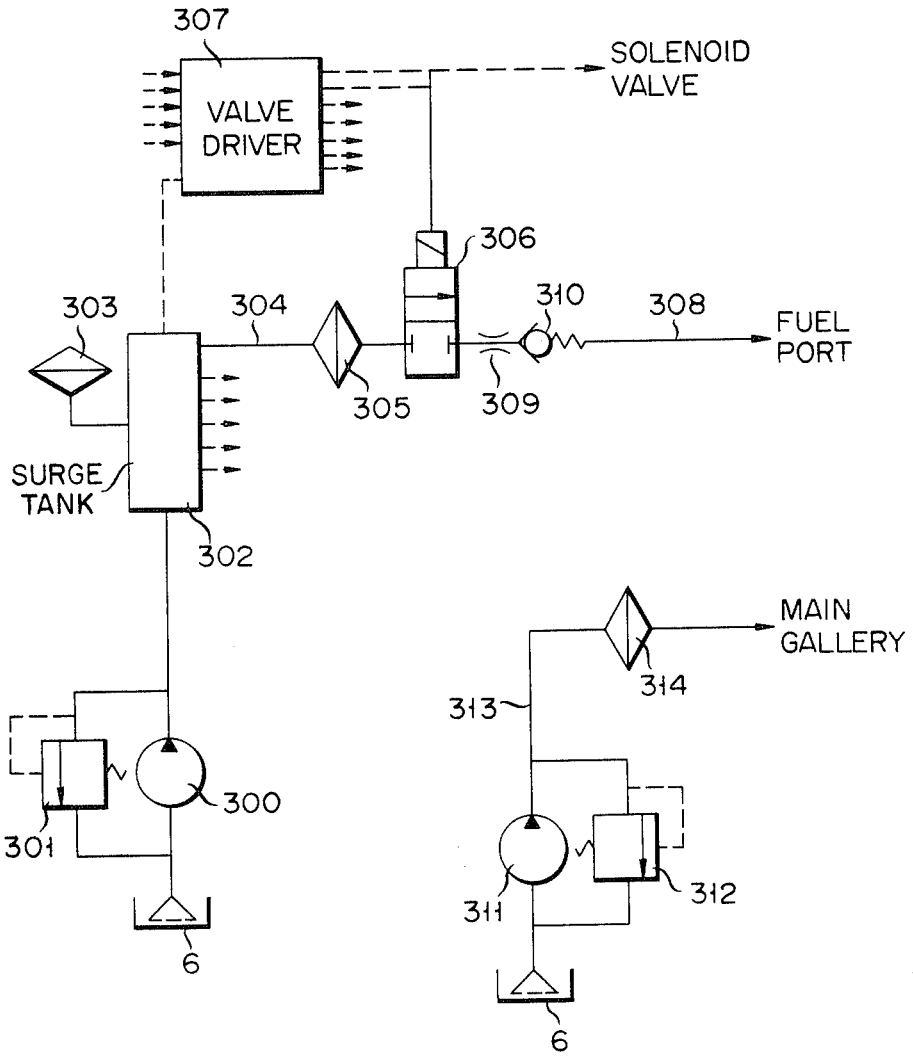
FIG. 7 shows a part of a fuel injection system according to a sixth embodiment of the present invention.

Referring to FIG. 7, the fuel delivery mechanism has a first feed pump 300. The first feed pump 300 draws the fuel from the fuel tank 6 and delivers it to a surge tank 301. The drawn fuel has a predetermined pressure adjusted by an adjusting valve 301. The pressure of the fuel in the surge tank 302 is stabilized by an accumulator 303. The fuel in the surge tank 302 is supplied to an adjusting solenoid valve 306 through a channel 304 and a filter 305. The adjusting solenoid valve 306 is controlled by a valve driver 307. The valve driver 307 controls the open period of the adjusting solenoid valve 306 in accordance with the operating conditions of the engine. Therefore, a required amount of fuel corresponding to the operating conditions of the engine is supplied to the fuel port 78 through a channel 308, an orifice 309 and a check valve 310.

The fuel delivery mechanism has a second feed pump 311. The fuel drawn by the second feed pump 311 has a controlled pressure and is supplied to the main gallery 45 through a channel 313 and a filter 314.

What is claimed is:

1. A fuel injection system for an internal combustion engine, comprising:

fuel delivering means for delivering a predetermined amount of fuel in accordance with operating conditions of the engine; and fuel injection means for injecting the fuel delivered from said fuel delivering means into a combustion chamber of the engine, said fuel injection means including a nozzle housing mounted at a cylinder head of the engine, the nozzle housing containing an injection cylinder chamber, a pressure cylinder chamber and a metering channel, the metering channel communicating said fuel delivering means to the injection cylinder chamber through the pressure cylinder chamber, an injection nozzle disposed at one end of said nozzle housing and being adapted to inject the fuel into the combustion chamber, an injection plunger slidably inserted in the injection cylinder chamber, said injection plunger being adapted to partition the injection cylinder chamber into an injection pump chamber and a pressurizing chamber therein, the injection pump chamber receiving the predetermined amount of fuel from said fuel delivering means through the metering channel and the pressure cylinder chamber, a pressurizing plunger slidably fitted in the pressure cylinder chamber, the pressurizing plunger defining a pressure pump chamber which communicates with the pressurizing chamber in the injection cylinder chamber, the metering channel being opened and closed by the movement of the pressurizing plunger, supplying means for supplying a fluid to the pressure pump chamber and the pressurizing chamber, and pressurizing plunger driving means adapted to reciprocate said pressurizing plunger in synchronism with the engine so that the metering channel is opened to supply the fuel from said fuel delivering means to the injection pump chamber when said pressurizing plunger moves in one direction, and the metering channel is closed and the fluid in the pressure pump chamber and the pressurizing chamber is pressurized, when the pressurizing plunger moves in another direction, and to move said injection plunger in a direction so as to pressurize the fuel in the injection pump chamber.

2. A system according to claim 1, wherein said injection plunger and said pressurizing plunger are located such that axes thereof are substantially aligned in series with each other.

3. A system according to claim 1, wherein said fuel delivering means comprises a distributor type fuel injection pump.

4. A system according to claim 3, wherein the fuel injection pump also serves as said fluid supplying means.

5. A system according to claim 1, wherein a diameter of said pressurizing plunger is larger than a diameter of said injection plunger.

6. A system according to claim 1, wherein said pressure cylinder chamber and said injection cylinder chamber are located in a single cylinder portion.

7. A system according to claim 6, wherein said injection plunger and said pressurizing plunger are disposed such that axes thereof are aligned to be substantially parallel to each other.

8. A system according to claim 7, wherein said injection plunger moves in the same direction as a direction of movement of said pressurizing plunger.

9. A system according to claim 7, wherein said injection plunger moves in a direction opposite to a direction of movement of said pressurizing plunger.

10. A system according to claim 6, wherein said injection plunger and said pressurizing plunger are disposed such that axes thereof cross each other.

11. A system according to claim 1, wherein said fuel injection means further includes a timing control mechanism for controlling the pressurizing timing of the fluid pressurized by said pressurizing plunger in said pressure pump chamber.

12. A system according to claim 11, wherein said timing control mechanism comprises a timing channel communicating with said pressure pump chamber to spill the fuel therefrom, a solenoid valve for opening/closing said timing channel, and a valve driver for controlling an opening/closing operation of said solenoid valve in accordance with the operating conditions of the engine.

* * * * *